United States Patent [19]

Aeschliman

[11] 4,044,700

[45] Aug. 30, 1977

[54] SEWING MACHINE SUPPORT STRUCTURE AND WORK SURFACE

[75] Inventor: Eugene Aeschliman, Jackson, Miss.

[73] Assignee: DeSoto, Inc., Des Plaines, Ill.

[21] Appl. No.: 722,016

[22] Filed: Sept. 10, 1976

[51] Int. Cl.[2] ..... D05B 75/02

[52] U.S. Cl. ..... 112/217.1; 12/258; 108/90

[58] Field of Search ..... 112/260, 258, 217.1; 312/22, 23, 29, 27, 30; 108/13, 83, 90

[56] References Cited

U.S. PATENT DOCUMENTS

| | | | |
|---|---|---|---|
| 150,775 | 5/1874 | Murphy | 112/217.1 X |
| 2,247,380 | 7/1941 | Hohmann | 112/219.1 |
| 2,247,383 | 7/1941 | Hohmann et al. | 112/260 |
| 3,797,425 | 3/1974 | Peets | 112/217.1 |

*Primary Examiner*—George H. Krizmanich

*Attorney, Agent, or Firm*—Arnstein, Gluck, Weitzenfeld & Minow

[57] ABSTRACT

A sewing machine support structure in which the machine is slidable in a horizontal plane from in-use to out-of-use position and vice-versa, and in either position, the machine always is in full view, never concealed. Additionally, means are provided for mounting the machine so that it may be selectively moved vertically to position a convertible type sewing machine in a flat bed or free arm mode of operation.

7 Claims, 7 Drawing Figures

SEWING MACHINE SUPPORT STRUCTURE AND WORK SURFACE

BACKGROUND OF THE INVENTION

This invention relates to a sewing machine support structure and work surface.

Heretofore, conventional sewing machine cabinets were of the type which supported a sewing machine in operative or in-use position on a planar work supporting surface and in out-of-use or storage position housed the machine in a compartment below the work supporting surface and concealed from view.

The present invention is related to a sewing machine support structure in which the machine both in in-use and out-of-use positions is supported on a work surface always in full view, never concealed, and is shiftable in the plane of work surface to in-use and out-of-use positions. While my invention is applicable for use with conventional flat bed type sewing machines, it is particularly useful with convertible type sewing machines which may be mounted so that they may be selectively disposed in flat bed or free arm modes, in addition to in-use or out-of-use positions.

BRIEF DESCRIPTION OF A PREFERRED EMBODIMENT

Figure 1:
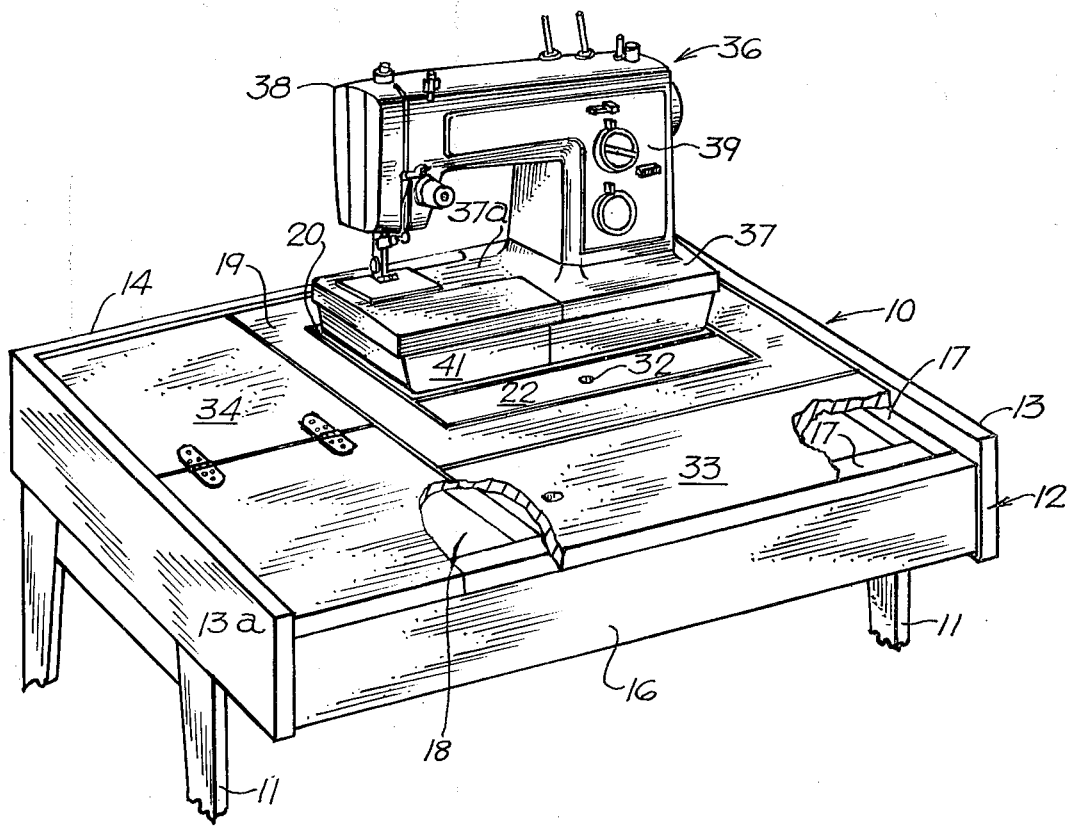
FIG. 1 is a perspective view, with a portions broken away, of sewing machine support structure, in accordance with my invention, illustrating a convertible type sewing machine in non-operating or out-of-use position.

The support structure in accordance with my invention includes a table, indicated generally by the numeral 10, and supported on four legs 11. The table 10 includes a rectangular frame 12 comprised of side walls 13, 13*a*, rear wall 14 and a front wall 16. As seen in the drawings, the upper edge of the front wall 16 terminates short of the upper edges of the side and rear walls 13 and 14, respectively. A slide rail 17 constituting a shoulder is secured to the inner side of each of the side, front and rear walls and extends longitudinally of each such wall. The upper edge of each rail 17 is substantially coplanar with the upper edge of the front wall 16. An intermediate wall 18 extends between the front and rear walls 16 and 14 respectively, in parallel relation to the side walls 13. The upper edge of the intermediate wall 18 is coplanar with the upper edge of the front wall 16.

Figure 7:
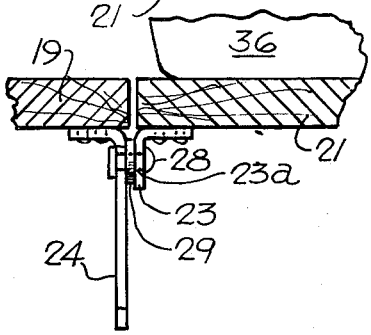
FIG. 7 is a fragmentary cross-sectional view taken on line 7—7 of FIG. 6.

Slidably supported on the rail 17 and on the intermediate wall 18 constituting horizontal support members is a panel 19 having generally rectangular cut-out 20 spaced inwardly from all of the edges of the panel. A pair of panels 21 and 22 are received in said cut-out, as will be hereinafter explained. Secured in depending relation at each side of the larger panel 21, is an angle bracket 23 having a pair of spaced holes 23*a* therein. A pair of L-shaped brackets 24 is secured to the underside of the panel 19, each adjacent a side edge of cut-out 20 and each arranged in confronting relation to a respective angle bracket 23, as illustrated in FIG. 7. Each depending leg 26 of each bracket 24 is provided with a pair of spaced generally vertically positioned slots 27, each slot being shaped substantially like an inverted J and disposed in registration with a respective hole 23*a*. A headed pin 28 is passed through each registering hole 23*a* and slot 27 and through a spacer washer 29 which is interposed between confronting adjacent brackets. As should be apparent the panel 21 is movable vertically, being guided by the slots 27, as hereinafter will be more fully explained.

The panel 22 is of reduced width and is received in the open space between the panel 21 and the forward edge of the cut-out 20. The panel 22 rests on a pair of rails 31 secured to the underside of the panel 19 adjacent the cut-out 20. A finger engaging aperture 32 is provided to facilitate removal of the panel 22 from the cut-out 20. A third rectangular panel 33 is supported on the rail 17 and intermediate wall 18 which also supports panel 19.

A hinged cover panel 34 is provided for the accessory storage compartment defined by the intermediate wall 18 and the opposite side wall 13*a*. Said cover panel is rested on the intermediate wall 18 and a rail, not shown, carried on side wall 13*a*.

Figure 2:
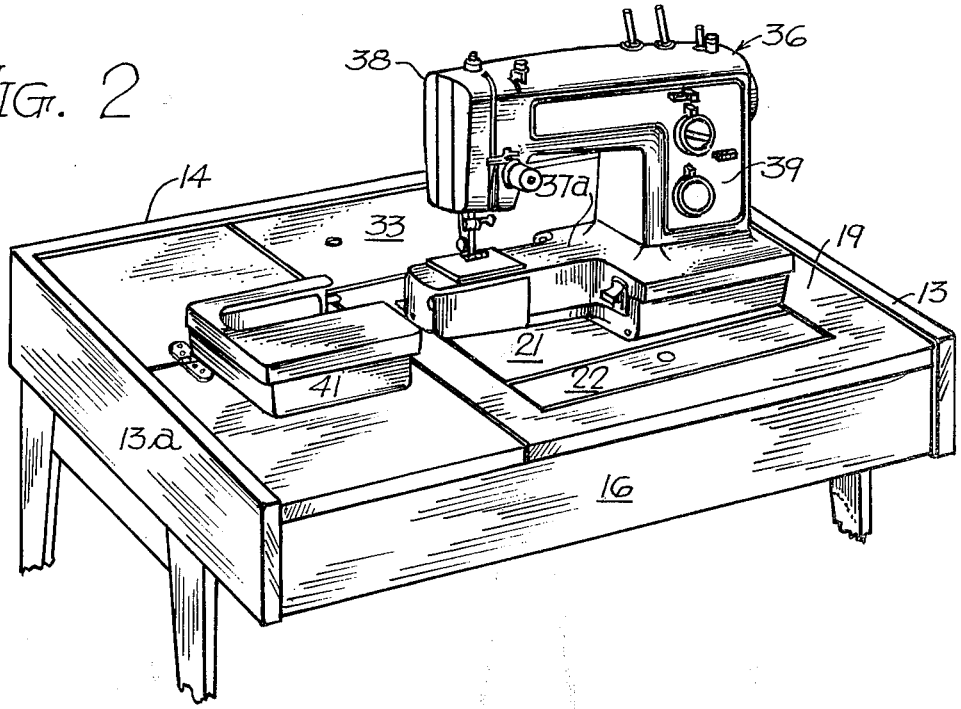
FIG. 2 is a similar view, but illustrating the sewing machine in in-use position with a portion of the base of the sewing machine in separated relation to permit the machine to be used in a free arm mode.
Figure 3:
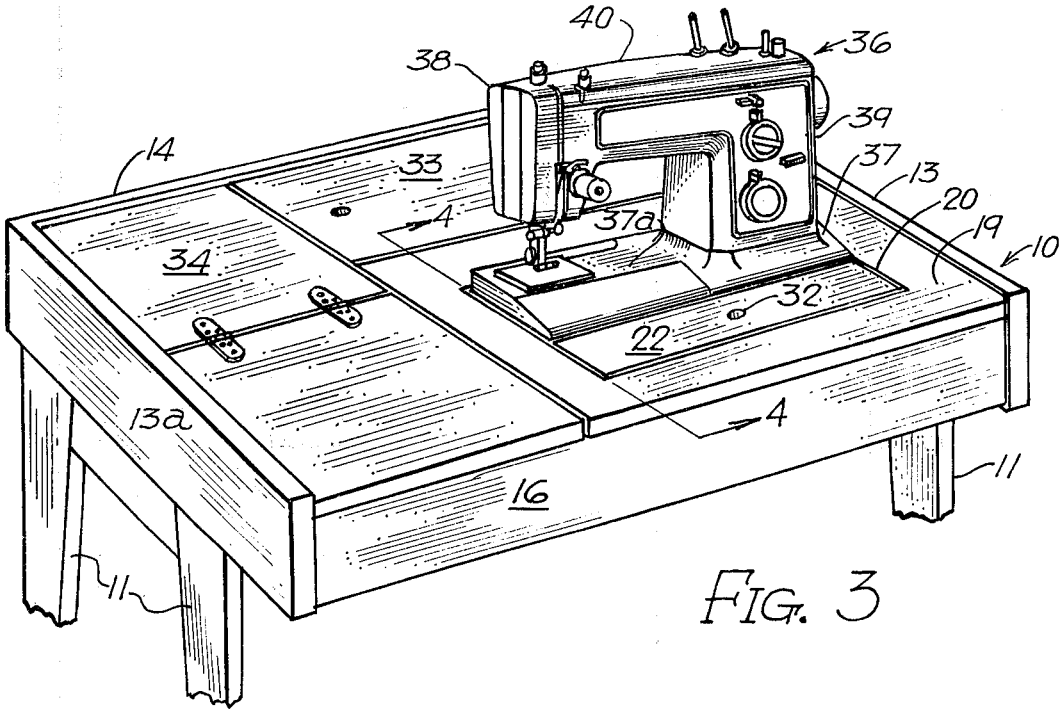
FIG. 3 is view similar to FIG. 2 and showing the sewing machine in use in a flat bed mode.
Figure 4:
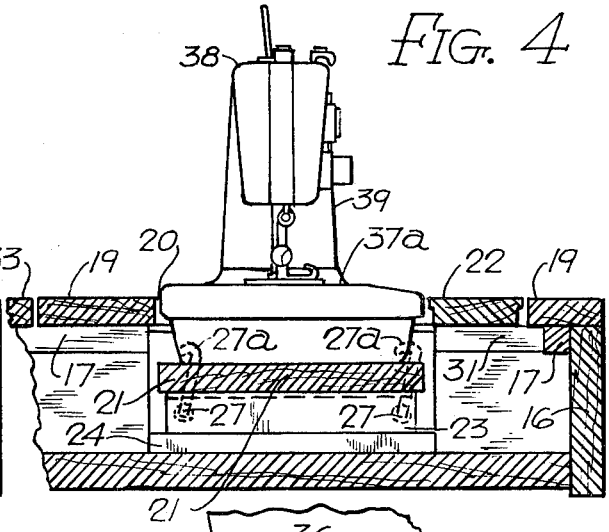
FIG. 4 is a fragmentary cross-sectional view taken substantially on line 4—4 of FIG. 3.
Figure 6:
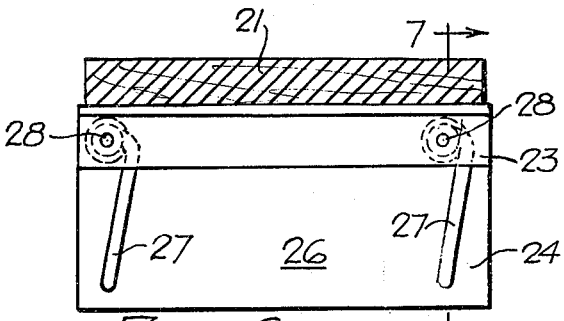
FIG. 6 is a fragmentary view on an enlarged scale of a portion of the structure shown in FIG. 5.

A sewing machine of any type may be secured to and supported on the panel 21. However, the support structure of my invention is particularly adapted for supporting a convertible type sewing machine 36, as illustrated, which may be selectively used either in a free arm or a flat bed mode. It will be understood that the sewing machine illustrated does not comprise a part of the present invention. However, a brief description of the same is appropriate here for a clearer understanding of the present invention. The sewing machine 36 comprises a base 37 which includes a hollow standard 39 carrying an overhanging arm 40 terminating in a hollow head 38 in which is mounted a conventional needle bar and presser bar. The base 37 is generally T-shaped in plan and includes a main body portion having a longitudinally extending integral arm 37*a* of reduced width disposed in vertical registration with the overhanging arm 40. Conventional loop taker and feed mechanisms, not shown, are housed within the arm 37*a*. An auxiliary component or shoe 41, shaped substantially as illustrated in FIG. 2, is constructed to be complemental to the base 37 and is adapted for removable attachment thereto, so that when assembled to the base 37 the machine may be used in a flat bed mode, as illustrated in FIGS. 3 and 4, or when separated from the base, the machine may be used in a free arm mode, as illustrated in FIGS. 2 and 5.

To use the machine either in a free arm or flat bed mode, the panel 21 on which the machine 36 is secured is moved by the operator from one position to another, the panel 21, in its movement, being guided by the movement of pins 28 in the slots 27. As seen in FIG. 4, the panel 21 is in its lower position, with the pins 28 engaging the lower ends of the slots 27. In such position, the surface of the base machine is disposed substantially in operative registration with the surfaces of the panels 19, 22 and 23. Thus, in this position, as shown in FIG. 3, the machine 36 is disposed in a flat bed mode of use with the shoe 41 assembled to the base of the machine.

Figure 5:
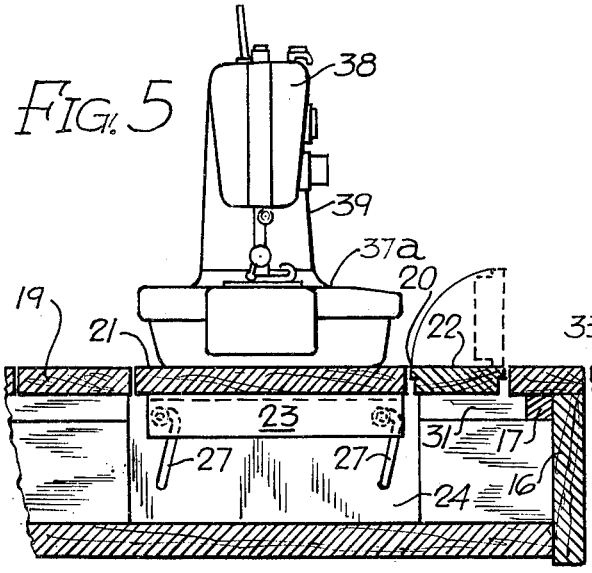
FIG. 5 is a view similar to FIG. 4 but showing the machine disposed in a free arm mode.

In order to move the machine 36 to a free arm mode of use, the operator lifts the machine and panel 21 to the upper position illustrated in FIG. 5 wherein the pins 28 engage the ends of the rearwardly directed arcuate portions 27*a* of the slots 27. In such position the panel 21 is disposed coplanar with the adjacent panels 22 and 33. However, the machine 36 is now in such position that the shoe 41 may be slid away and removed from the base 37 of the machine to expose the arm 37*a* so that the machine may be used in a free arm mode. It will be noted that each of the slots 27 is inclined away from a vertical plane and that the upper and lower ends of each slot in which the pins 28 come to rest are substantially in vertical registration. Thus, in moving from one position to another, both up and down, the panel 21 is caused to move laterally to the left to a limited degree, as viewed in FIGS. 4 and 5. Such lateral movement is permitted when panel 22 is tipped upwardly to a vertical position, as illustrated by the broken lines in FIG. 5, to afford the necessary clearance for the forward movement of panel 21. Thereafter, panel 22 is returned to its horizontal position, as shown.

Panel 19 is slidable on rail 17 and wall 18 after the panel 33 is lifted off its supports to enable the positioning of the machine 36 in either mode, to in-use or out-of-use positions. Panel 33 then is replaced to fill the open area. For example, as shown in FIG. 1, the machine 36 with the shoe 41 assembled is disposed in elevated position corresponding to a free arm mode of use but is in out-of-use position remote from the front wall 16. Here, panel 19 is in a rearward position and panel 33 is in a forward position. It will be understood that in out-of-use position the machine 36 also may be disposed in lowered position corresponding to a flat bed mode.

To shift the machine 36 to in-use or operating position, from that shown in FIG. 1, the panel 33 is lifted out and panel 19 and machine 36 are slid forwardly to the position illustrated in FIG. 2. Panel 33 is then placed in its rearward position, as shown. In such operating position, the machine 36 may be selectively disposed in a flat bed mode of use, as shown in FIG. 4, or in a free arm mode of use, as shown in FIG. 5.

In order to shift the machine 36 to out-of-use position the panel 33 is removed from the position shown in FIG. 2, panel 19 is slid rearwardly and panel 33 then is placed in the forward position illustrated in FIG. 1.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. A support structure for a sewing machine comprising a frame supported on a plurality of legs, said frame including a pair of horizontal support members, a first horizontal panel member slidably supported on said support members, a sewing machine supported on said first horizontal panel member, a second horizontal panel member removably supported on said support members contiguous to said first panel member and coplanar therewith, said first and second panel members constituting the work surface of said support structure, said first panel member and said member being selectively slidable on said support members to position said machine in in-use or out-of-use positions with said second panel member being disposed either rearwardly or forwardly in relation to said first panel member.

2. A support structure for a sewing machine comprising a frame supported on a plurality of legs, said frame including a pair of horizontal support members, a first horizontal panel member slidably supported on said support members, said first panel member having a cut-out, a support panel movably received in said cut-out, a sewing machine supported on said support panel, a pair of brackets secured in depending relation to the under side of said first panel member, each bracket being adjacent a respective side of said cut-out, each of said brackets having a pair of generally vertical guide slots, and said support panel having cooperating means engaged in said slots for guiding said support panel for movement to selected vertical positions.

3. The invention as defined in claim 2 including a second horizontal panel member removably supported on said support members contiguous to said first panel member an coplanar therewith, said first and second panel members constituting the work surface of said support structure, said first panel member and said machine being selectively slidably on said support members to position said machine in in-use or out-of-use positions with said second panel member being disposed either rearwardly or forwardly in relation to said first panel member.

4. A support structure for a sewing machine which is selectively usable in a free arm or flat bed mode of use, said support structure comprising a frame supported on a plurality of legs, said frame including a pair of horizontal support members, a first horizontal panel member slidably supported on said support members, said first panel member having a cut-out, a support panel movably received in said cut-out, a sewing machine supported on said support panel, a pair of registering brackets secured in depending relation to the underside of said first panel member, each bracket being adjacent a respective side of said cut-out, each of said brackets having a pair of generally vertical guide slots, means engaged in said slots for guiding said support panel for movement to selected vertical positions, said support panel when in its uppermost position positioning said machine in a free arm mode of use and said support panel when in its lowermost position positioning said machine in a flat bed mode of use.

5. The invention as defined in claim 2 including a third panel member removably received in said cut-out and disposed forwardly of and adjacent to said support panel.

6. The invention as defined in claim 1 and including a hinged panel supported on said frame adjacent said first and second panel members and coplanar therewith.

7. The invention as defined in claim 2 and including a hinged panel supported on said frame adjacent said first and second panel members and coplanar therewith.

* * * * *

UNITED STATES PATENT OFFICE
CERTIFICATE OF CORRECTION

PATENT NO. : 4,044,700

DATED : August 30, 1977

INVENTOR(S) : Eugene Aeschliman

It is certified that error appears in the above-identified patent and that said Letters Patent are hereby corrected as shown below:

Column 2, line 68, numeral "23" should be --33--.

Claim 1, column 4, line 4, "member" (second occurrence) should be -- machine --.

Claim 3, column 4, line 4, "an" should be -- and --.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*